US011458370B2

(12) United States Patent
Holzner et al.

(10) Patent No.: US 11,458,370 B2
(45) Date of Patent: Oct. 4, 2022

(54) METHOD FOR EMBEDDING ELECTRONICS INTO A PUCK AND PUCK HAVING EMBEDDED ELECTRONICS

(71) Applicant: KINEXON GmbH, Munich (DE)

(72) Inventors: Simon Holzner, Munich (DE); Bernhard Johann Bohn, Garching (DE)

(73) Assignee: KINEXON GMBH, Munich (DE)

( * ) Notice: Subject to any disclaimer, the term of this patent is extended or adjusted under 35 U.S.C. 154(b) by 0 days.

(21) Appl. No.: 16/296,572

(22) Filed: Mar. 8, 2019

(65) Prior Publication Data

US 2019/0308076 A1 Oct. 10, 2019

(30) Foreign Application Priority Data

Mar. 9, 2018 (EP) ..... 18161049

(51) Int. Cl.
*A63B 43/00* (2006.01)
*A63B 24/00* (2006.01)
(Continued)

(52) U.S. Cl.
CPC ..... *A63B 43/002* (2013.01); *A63B 24/0021* (2013.01); *A63B 45/00* (2013.01);
(Continued)

(58) Field of Classification Search
CPC ... A63B 43/002; A63B 43/00; A63B 24/0031; A63B 24/0021; A63B 45/00;
(Continued)

(56) References Cited

U.S. PATENT DOCUMENTS 5,564,698 A * 10/1996 Honey ..... G01S 3/7864 473/588
5,912,700 A 6/1999 Honey et al.
(Continued)

FOREIGN PATENT DOCUMENTS

WO WO-2015058190 A1 * 4/2015 ..... A63B 37/0051
WO 2018027280 A1 2/2018
WO WO-2018027280 A1 * 2/2018 ..... A63B 37/0023

OTHER PUBLICATIONS

Search Report for European Patent Application No. 18 16 1049 dated Aug. 15, 2018.
(Continued)

*Primary Examiner* — John E Simms, Jr.
*Assistant Examiner* — Rayshun K Peng
(74) *Attorney, Agent, or Firm* — Calfee Halter & Griswold LLP

(57) ABSTRACT

A puck embedding at least one transmitter circuit, and a method for producing a puck embedding at least one transmitter circuit. To protect the electronics from displacement or damage, the puck employs a layered structure. The puck has a centrally located cavity, containing a carrier structure having a rigid shell, at least one transmitter circuit supported by the carrier structure, and a battery provided within the carrier structure. The battery is embedded in a first elastic material provided within the carrier structure. The carrier structure is embedded in a second elastic material provided within the centrally located cavity.

18 Claims, 3 Drawing Sheets

(51) Int. Cl.

| | |
|---|---|
| ***A63B 67/14*** | (2006.01) |
| ***A63B 45/00*** | (2006.01) |
| *A63B 69/00* | (2006.01) |
| *A63B 102/24* | (2015.01) |

(52) U.S. Cl.
CPC ..... *A63B 67/14* (2013.01); *A63B 43/00* (2013.01); *A63B 69/0024* (2013.01); *A63B 2102/24* (2015.10); *A63B 2209/02* (2013.01); *A63B 2220/13* (2013.01); *A63B 2220/18* (2013.01); *A63B 2220/30* (2013.01); *A63B 2220/40* (2013.01); *A63B 2220/53* (2013.01); *A63B 2220/80* (2013.01); *A63B 2220/833* (2013.01); *A63B 2225/50* (2013.01); *A63B 2225/54* (2013.01)

(58) Field of Classification Search
CPC . A63B 67/14; A63B 2102/24; A63B 69/0024; A63B 69/0026; A63B 2220/83; A63B 2209/02
USPC ..... 473/570
See application file for complete search history.

(56) References Cited

U.S. PATENT DOCUMENTS

| | | | | |
|---|---|---|---|---|
| 10,062,027 | B2 * | 8/2018 | Komatsu | A63B 37/0043 |
| 2002/0091017 | A1 | 7/2002 | Kuesters | |
| 2009/0040761 | A1 | 2/2009 | Huang et al. | |
| 2013/0073248 | A1 * | 3/2013 | Perkins | A61B 5/6895 702/141 |
| 2014/0013361 | A1 * | 1/2014 | Monari | H04N 21/41415 725/62 |
| 2016/0074714 | A1 * | 3/2016 | Krysiak | A63B 43/06 473/570 |
| 2018/0065012 | A1 * | 3/2018 | Mason | A63B 24/0021 |
| 2018/0311562 | A1 * | 11/2018 | Moyerman | A63B 69/0026 |
| 2019/0224531 | A1 * | 7/2019 | McDermott | A63B 37/00622 |

OTHER PUBLICATIONS

Office Action for Canadian Patent Application No. 3036032 dated Apr. 17, 2020.

* cited by examiner

METHOD FOR EMBEDDING ELECTRONICS INTO A PUCK AND PUCK HAVING EMBEDDED ELECTRONICS

CROSS RELATED APPLICATIONS

This application claims the benefit of the priority of European Patent Application No. 18161049.4, filed Mar. 9, 2018, and herein incorporated by reference in its entirety, where such incorporation is permitted.

FIELD OF THE INVENTION

The present invention relates to a puck embedding electronics, specifically a radio transmitter, in a way that prevents damage to the electronics when the puck experiences mechanical stress.

BACKGROUND OF THE INVENTION

A ball or a puck equipped with an electronic tag allows tracking of its position during a ball game. Electronic tracking of the position can support referees in overseeing the game, provide insights for trainers aiming to improve the game-play of a team, or provide an augmented experience for spectators. Ice hockey pucks, specifically, are small and fast moving objects particularly difficult to track by naked eye, enhancing the relative benefit provided by electronic tracking of the puck.

Balls and pucks equipped with an antenna for tracking the position of the ball or puck are well known in the state of the art. Specifically, a hockey puck containing a radar repeater embedded within the rubber section of the puck is described in U.S. Pat. No. 5,564,698. The puck contains circuitry comprised in a printed circuit board and a battery vertically stacked in the center of the printed circuit board, which are held in place using a flexible epoxy.

A hockey puck containing electronics is also described in US 2016/0317875 A1 which relates to an illuminated hockey puck. The puck has a cylindrical cavity centered on the natural axis of rotation which contains an electronic module including a battery. The casing of the electronic module has an outside dimension that is a snug fit into the cylindrical cavity of the puck. The bottom portion of the casing is thicker than the cover of the casing to compensate for the weight of the battery which is provided above the median plane of the illuminated hockey puck.

Hockey pucks experience immense mechanical forces when the puck is hit by a player's stick or impacts on a barrier. When the mechanical forces are transferred to the electronics in the puck, the electronics, in particular the battery, is likely to be damaged quickly, risking a loss of function during game-play. Hockey pucks embedding electronics according to the state of the art do not provide for an embedding that sufficiently protects electronics. To protect the electronics, a puck must firmly embed the electronics to prevent deformation of circuitry and displacement of electronic components. Yet, an embedding that is rigid also transfers all mechanical stress to the electronics, which quickly causes damage to the circuitry and fatigue of material.

A further problem is implied by the operating of transmitters close to an ice surface. Because of its relatively high dielectric constant, ice strongly absorbs electromagnetic radiation. Thus, a transmitter transmitting close to an ice surface does not work efficiently, hampering the reception of the signal of the puck.

It is the object of the present invention to improve the embedding of electronics in a puck.

This object is solved by the subject-matter of the independent claims.

Embodiments are defined by the dependent claims.

The present invention provides an improved embedding of electronics in a puck. The embedding employs a layered structure of elastic materials inside the puck. The puck has a centrally located cavity in which a carrier structure having a rigid shell is positioned. The carrier structure supports at least one transmitter circuit. Within the carrier structure, a first elastic material is provided in which a battery is embedded. The carrier structure is embedded in a second elastic material provided within the centrally located cavity.

The present invention further provides a method for producing a puck containing at least one transmitter circuit. The method comprises assembling a battery into a carrier structure that has a rigid shell, attaching at least one transmitter circuit to the carrier structure, and filling the inner volume of the carrier structure with a first elastic material. The method further comprises inserting the carrier structure into a recess on the inner surface of a first half of the puck, filling the remaining space with a second elastic material, and glueing a second half of the puck to the first half of the puck. The second half of the puck has a recess such that the recess in the first half of the puck and the recess in the second half of the puck combine to form a cavity which is centrally located within the puck.

The present invention provides for a better protection of electronics embedded in a puck against damage caused by mechanical stress. The invention is based on the notion that the electronic circuitry must be embedded firmly but not too rigidly to ensure a sufficiently long lifetime of the electronics. Embedding electronics in a puck can be advantageously accomplished by employing different layers, of potentially differential stiffness, in which soft layers absorb mechanical energy, and hard, stiff layers protect susceptible structures inside the puck from deformation. The carrier structure having a rigid shell provides a firm embedding of the transmitter circuit preventing relative displacement among the components of the transmitter circuit under mechanical stress, while the first and the second elastic materials provide layers that absorb the mechanical energy transferred to the puck in an impact.

According to an embodiment, the second elastic material has a smaller hardness than the first elastic material. According to further embodiments, the first and the second elastic materials exhibit a gradual change in stiffness from harder to softer. In this way, the second elastic material which is closer to the surface of the puck, can absorb mechanical energy while the first elastic material protects the electronic components from deformation.

According to an embodiment, the carrier structure supports a first transmitter circuit and a second transmitter circuit. The first transmitter circuit is comprised in a first printed circuit board and the second transmitter circuit is comprised in a second printed circuit board, wherein the first printed circuit board is fitted to a top opening of the carrier structure and the second printed circuit board is fitted to a bottom opening of the carrier structure.

According to a further embodiment, the puck further comprises circuitry configured to switch between activating the first or the second transmitter circuit such that the transmitter circuit near the planar surface of the puck currently facing upwards is activated and the transmitter circuit near the planar surface of the puck currently facing downwards is deactivated. The transmitter circuit near the planar surface of the puck currently facing downwards is closer to the ice surface and, thus, cannot transmit efficiently. Deactivating this transmitter circuit thus saves energy and improves the transmission by reducing interference.

In an embodiment, the method for producing a puck further comprises fitting a first printed circuit board comprising a first transmitter circuit to a top opening of the rigid shell of the carrier structure, and fitting a second printed circuit board comprising a second transmitter circuit to a bottom opening of the rigid shell of the carrier structure.

In a still further variant of this embodiment, the rigid shell of the carrier structure has at least one hole located on faces of the rigid shell, and filling the inner volume of the carrier structure with a first elastic material comprises injecting the first elastic material through at least one of the holes into the inner volume of the carrier structure.

In a further embodiment, the recess in the first half of the puck is such that contact surfaces between the first half of the puck and the second half of the puck comprise surfaces parallel to the axis of rotation of the puck, improving the structural persistence of the glued connection.

BRIEF DESCRIPTION OF THE DRAWINGS

Embodiments of the present invention are shown in the enclosed drawings in which.

The following detailed description and accompanying drawings provide a more detailed understanding of the nature and advantages of the present invention.

DETAILED DESCRIPTION OF THE INVENTION

A puck containing a transmitter circuit and a method of producing the puck will be described in detail in the following. For purposes of explanation, examples and specific details are set forth in order to provide a thorough understanding of the embodiments of the present invention. Embodiments as defined by the claims may include some or all of the features in these examples alone or in combination with other features described below and may further include modifications and equivalents of the features and concepts described herein. The following description will refer to FIGS. 1 to 5 explaining embodiments of the present invention in detail.

Figure 1:
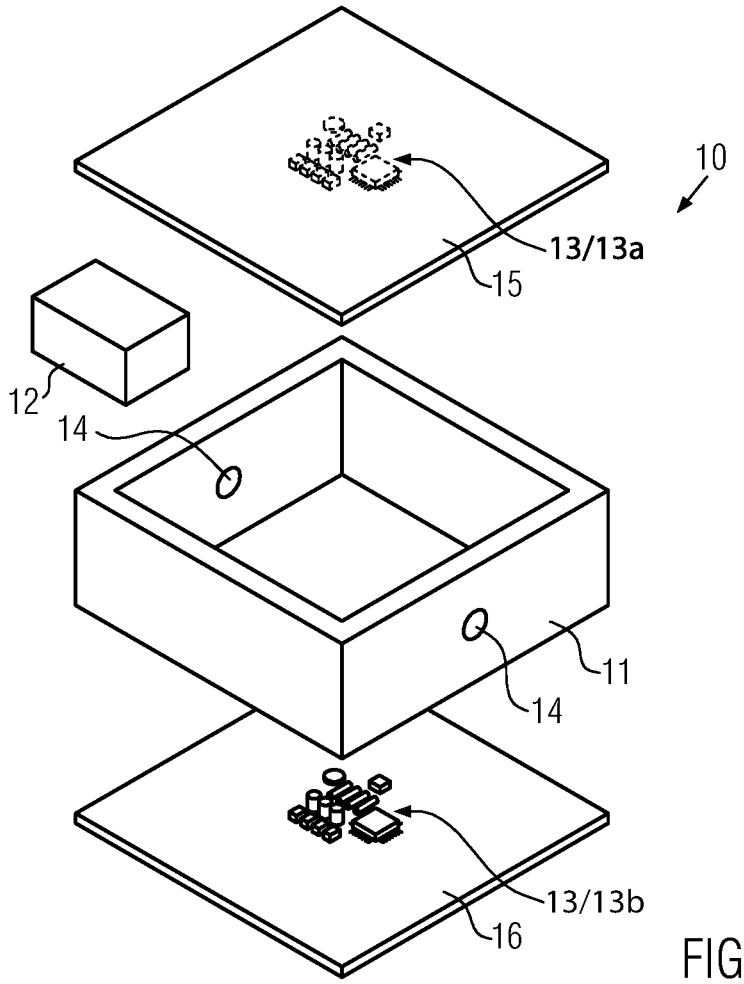
FIG. 1 is an exploded view showing a carrier structure, a battery and two printed circuit boards comprising transmitter circuits according to an embodiment of the invention.

FIG. 1 shows an exploded view of components positioned within a puck according to embodiments of the invention. FIG. 1 shows a carrier structure 11 having a rigid shell. In an embodiment, the carrier structure 11 may be 3D printed. A battery 12, which may be a primary cell or a rechargeable battery, is located within the carrier structure 11. Further electronic circuitry (not shown in FIG. 1) connecting transmitter circuits to the battery 12, or an inertial measurement unit (IMU, not shown in FIG. 1) may be contained in the volume of the carrier structure 11. Preferably, the IMU is located near the center of mass of the puck. The IMU may comprise accelerometers, gyroscopes, and magnetometers. According to an embodiment, output of an accelerometer comprised in the IMU is used to detect an abrupt stop and/or change in direction of motion of the puck.

The rigid shell of the carrier structure 11 is illustrated as having the shape of a square cuboid. However, the rigid shell of the carrier structure 11 could also have another shape, such as a round shape. FIG. 1 further shows that the rigid shell of the carrier structure 11 includes holes 14 which may be used to fill the volume of the carrier structure 11 with an elastic material.

Transmitter circuits 13 are supported by the carrier structure 11. According to the exemplary embodiment, two transmitter circuits 13 supported by the carrier structure 11 are shown. Preferably, the battery 12 is positioned between the two transmitter circuits 13.

In another embodiment, only one transmitter circuit 13 is employed.

Furthermore, FIG. 1 shows the first transmitter circuit 13*a* as comprised on a first printed circuit board 15 and the second transmitter circuit 13*b* as comprised on a second printed circuit board 16.

In an embodiment, the first transmitter circuit 13*a* is positioned close to a first planar surface of the puck, and the second transmitter circuit 13*b* is positioned close to a second planar surface of the puck. Thus, when the puck is sliding on an ice surface, one of the two transmitter circuits 13 is close to a planar surface of the puck facing upwards, away from the surface of the ice, and therefore can transmit effectively so that its signals can be properly received by receiving means.

In an embodiment, an antenna structure on the second printed circuit board 16 is rotated by 90° with respect to an antenna structure on the first printed circuit board 15. This configuration reduces the interference between the two antennas.

In an embodiment, the printed circuit boards 15,16 may also provide support for one or more IMUs.

Furthermore, the puck may contain switching circuitry (not shown in FIG. 1) configured to switch between activating the first or the second transmitter circuit such that the transmitter circuit near the surface of the puck facing upwards is activated while the second transmitter circuit near the surface of the puck facing downwards is deactivated. The switching circuitry may be configured to determine which of the transmitter circuits 13 is currently near the surface of the puck facing upwards using input provided by an IMU.

Figure 2:
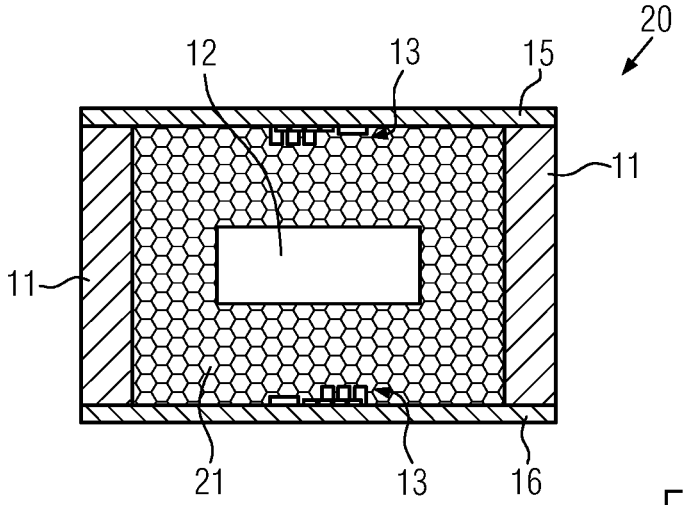
FIG. 2 shows a cross-section of the assembled carrier structure according to an embodiment of the invention.

FIG. 2 shows a cross-section of the assembled carrier structure 20. Assembled carrier structure 20 comprises carrier structure 11, battery 12, the first transmitter circuit 13*a* comprised on the first printed circuit board 15, and the second transmitter circuit 13*b* comprised on the second printed circuit board 16. As shown in FIG. 2, the volume of carrier structure 11 is filled with a first elastic material 21. The first elastic material 21 fills the volume of the carrier structure 11 so that no free volume remains. The first elastic material 21, which may be a two-component silicone rubber, has a relatively high hardness. In an embodiment, the first elastic material 21 has a hardness of about Shore A 40, which exhibits a solid level of protection for the enclosed circuitry and components.

Figure 3:
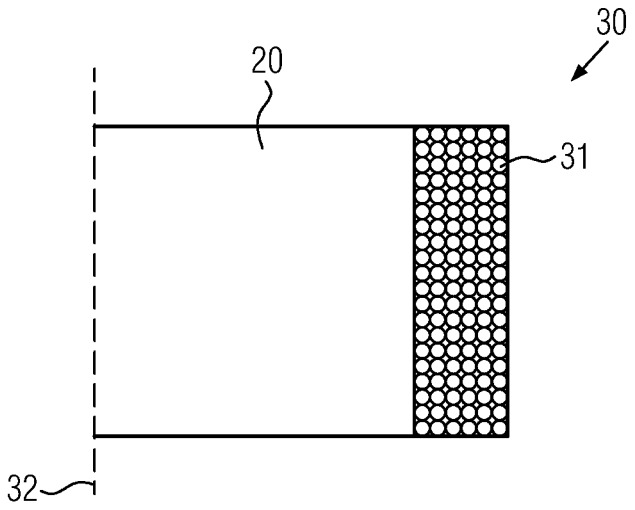
FIG. 3 shows a cross-section of one half of the assembled carrier structure provided with a high-stiffness layer according to an embodiment of the invention.

FIG. 3 shows a cross-section of a portion of an assembled structure 30 which comprises assembled carrier structure 20 and a layer 31 of material having high stiffness, such as a glass fiber thread infused with epoxy which surrounds assembled carrier structure 20. The other portion of the assembled carrier structure 20 left of plane 32 is analogously surrounded by a high-stiffness layer 31. Plane 32 as shown in the view of FIG. 2 may contain the axis of rotation of the puck when the assembled structure 30 is centrally positioned in a centrally located cavity of a puck.

In an embodiment, the high-stiffness layer 31 covers the faces of the rigid shell of the assembled carrier structure 20 which are parallel to the axis of rotation of the puck. This protects the assembled carrier structure 20 against the strong mechanical stress acting on the lateral cylinder surface when the lateral cylinder surface of the puck impacts on a stick or on a barrier.

Figure 4:
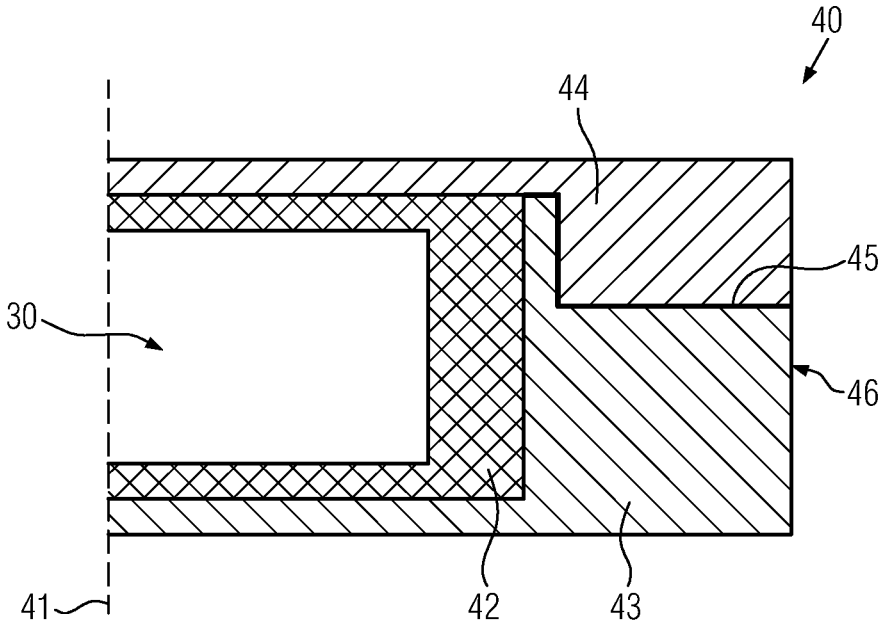
FIG. 4 shows a cross-section of one half of the puck containing a carrier structure positioned within a centrally located cavity according to an embodiment of the invention.

FIG. 4 shows a cross-section of a portion of a puck 40. The puck 40 has a centrally located cavity in which the assembled structure 30 is positioned. Alternatively, the centrally located cavity contains the assembled carrier structure 20 without being wrapped in a layer 31 of material having high stiffness such as a glass fiber thread infused with epoxy. According to an embodiment, the cavity is formed by a recess on the inner surface of a first half 43 of a puck, and a recess on the inner surface of a second half 44 of the puck. The second half 44 of the puck may be glued to the first half of the puck 43, for example, using cyanoacrylate.

In the embodiment as shown in FIG. 4, the recess in the first half 43 of the puck and the recess in the second half 44 of the puck are formed so that the contact surface 45 between the inner surfaces of the recess in the first half 43 of the puck and the recess in the second half 44 of the puck comprises a surface parallel to the axis of rotation of the puck. This increases the contact surface 45 along which the second half 44 of the puck is glued to the first half 43 of the puck. In addition, glueing surfaces parallel to the axis of rotation in addition to glueing surfaces orthogonal to the axis makes the glued connection more persistent under strong mechanical stress. Still further, providing the separation of the puck into two halves in the manner depicted in FIG. 4 allows for simplified filling of the recess in the first half 43 of the puck up to its brim.

A second elastic material 42 fills the space between the assembled structure 30 and the inner surface of the centrally located cavity. The second elastic material 42 supports the assembled structure 30 inside the centrally located cavity, In an embodiment, the second elastic material 42 is a two component silicone rubber. The second elastic material 42 may have a hardness of about Shore A 0.

In an embodiment, the different layers comprising the first and the second elastic materials are realized as discrete layers of distinct hardness. In an embodiment, the second elastic material 42 has a smaller hardness than the first elastic material 21. This allows the second elastic material 42 to compensate for the strong impact shocks suffered by an ice hockey puck, e.g. when it is hit by an ice hockey stick. One combination that has shown good characteristics according to the aim of embedding the electronic circuitry in an improved manner is a first elastic material 21 of a hardness of about Shore A 40 and a second elastic material 42 of a hardness of about Shore A 0.

As is known in the art, hardness of a material according to the Shore A scale is an indentation hardness value, empirically obtained by measuring the depth of an indentation created by a given force on a standardized presser foot. In contrast, stiffness is directly derived from Young's elasticity module. Materials of low stiffness can efficiently absorb mechanical energy. As is known to one skilled in the art, in many materials, stiffness increases with Shore A hardness. For example, for elastomers such as silicone rubber, a relation between stiffness and Shore A hardness is known.

Therefore, alternatively, the first and second elastic materials may be characterized by their stiffness. In particular, the first elastic material 21 and the second elastic material 42 have a relatively low stiffness, allowing the first elastic material 21 and the second material 42 to absorb the mechanical energy transferred to the puck on impact on a stick or a barrier. In an embodiment, the second elastic material 42 has a smaller stiffness than the first elastic material 21.

In alternative embodiments, instead of discrete layers of distinct stiffness, materials with a gradual change in stiffness may be employed. Such a material may be fabricated utilizing a multi-component injection mold or as a structured 3D print.

Figure 5:
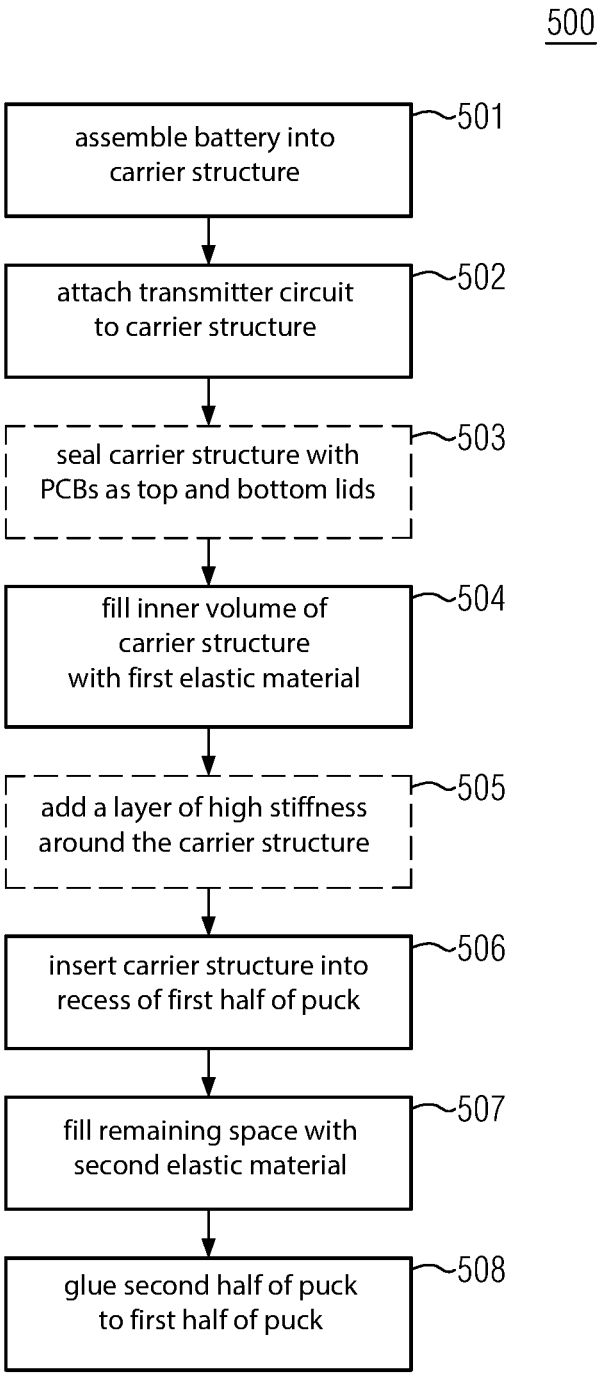
FIG. 5 shows a flow chart for producing a puck containing transmitter circuitry according to embodiments of the present invention.

FIG. 5, described with reference to FIGS. 1 and 4, shows elements shown in a flow chart of a method 500 for producing a puck containing a transmitter circuit. The method comprises assembling, 501, a battery 12 into a carrier structure 11, and attaching, 502, at least one transmitter circuit 13 to the carrier structure 11.

In an embodiment, the method further comprises fitting, 503, a first printed circuit board 15 comprising the first transmitter circuit 13*a* to a top opening of the carrier structure 11 and fitting a second printed circuit board 16 comprising the second transmitter circuit 13*b* to a bottom opening of the carrier structure 11. In this embodiment, the first printed circuit board 15 acts as a top lid for the carrier structure 11, while the second printed circuit board 16 acts as a bottom lid of the carrier structure.

The method 500 proceeds to filling, 504, an inner volume of the carrier structure 11 with a first elastic material 21, thereby embedding the battery 12 and further circuitry contained in the inner volume of the carrier structure 11.

In an embodiment, a rigid shell of the carrier structure 11 may further comprise at least two holes 14 located on faces of the rigid shell, and filling, 504, the inner volume of the carrier structure 11 with the first elastic material 21 comprises injecting the first elastic material 21 through at least one of the holes 14.

In an embodiment, the top opening of the rigid shell of the carrier structure 11 is covered by the first printed circuit board 15 forming a top lid, and the bottom opening of the rigid shell of the carrier structure 11 is covered by the second printed circuit board 16 forming a bottom lid. Thus, the first printed circuit board 15 forming a top lid and the second printed circuit board 16 forming a bottom lid seal the inner volume of the carrier structure 11 as the first elastic material 21 is injected through at least one of the holes 14.

In an embodiment, method 500 proceeds with adding, 505, a layer 31 of material of high stiffness around the assembled carrier structure 20 to produce assembled structure 30. In an embodiment, adding a layer 31 of high stiffness around the assembled carrier structure 20 may comprise infusing a glass fiber thread with epoxy, wrapping the glass fiber thread infused with epoxy around the assembled carrier structure 20, and letting the thread infused with epoxy dry.

Method 500 proceeds with inserting, 506, the assembled carrier structure 20 or the assembled structure 30 into a recess on the inner surface of a first half 43 of a puck. The recess in the first half 43 of the puck can be produced by milling out a recess in the inner surface of a half 43 of an ice hockey puck. In an embodiment, the recess and/or the carrier structure 11 may be such that in radial direction, towards the lateral cylinder surface 46 of the puck 40, the recess leaves more space between the outer surface of the carrier structure 11 and the inner surface of the recess, while the recess leaves less space in vertical direction between the top or bottom of the carrier structure 11 and the respective inner surface of the cavity.

Method 500 proceeds with filling, 507, the remaining space between the assembled carrier structure 20 or the assembled structure 30 and the inner surface of the recess with a second elastic material 42.

Method 500 concludes with glueing, 508, a second half 44 of the puck to the first half 43 of the puck. The recess in the second half 44 of the puck can be produced by milling out a recess in the inner surface of a second half 44 of the ice hockey puck. The second half 44 of the puck has an analogous recess on its inner surface, so that the recess in the first half 43 of the puck and the recess in the second half 44 of the puck form a centrally located cavity within the assembled puck 40, after the second half 44 of the puck has been glued to the first half 43 of the puck. Glueing the second half 44 of the puck to the first half 43 of the puck may employ glueing a contact surface 45 of the first half 43 of the puck with the second half 44 of the puck using cyanoacrylate.

The materials of the layers, including the carrier structure 11, the electronics, the battery 12, the first elastic material 21, the second elastic material 42, and, optionally, the high-stiffness layer 31 are chosen such that the average density of the layered structure matches the density of the puck material. Therefore, the weight of the assembled puck 40 is not changed by the layered structure contained in the centrally located cavity in comparison with a puck not containing the centrally located cavity and the layered structure.

In an embodiment, the battery 12 comprised in the puck is a rechargeable battery, and the puck 40 further comprises a coil that allows inductive charging of the rechargeable battery, and/or contacts on the puck surface which allow plugging a power supply for charging the rechargeable battery.

For tracking of the current location of the puck 40, signals emitted by the at least one transmitter circuit 13 embedded in the puck 40 may be received by several receivers connected to processing means. The processing means or the electronic device may comprise a computer, a mobile phone, a smartphone, a tablet computer, a notebook computer, or a wearable device. The processing means can be connected to the one or more receivers to process the radio signal and/or the radio signal characteristics measured by the one or more receivers. The processing means may be connected wirelessly or wired to the one or more receivers.

As is known to one skilled in the art, the position of the puck may be determined by utilizing at least one of Time-of-Arrival ToA, Time-Difference of Arrival TDoA, Two-Way Ranging TWR, Three-Way Ranging 3WR, Angle-of-Arrival AoA, Phase Difference of Arrival, PDoA, and Radio Signal Strength Indicator (RSSI)-based techniques.

The processing means may employ a Kalman filter to increase the accuracy of the tracking of the puck.

According to an embodiment, output of an accelerometer comprised in the IMU in the puck 40 is used to determine whether an abrupt stop and/or change in direction of motion of the puck has occurred. Upon determining that an abrupt stop and/or change in direction of motion of the puck has occurred, a corresponding signal is transmitted, via the at least one transmitter comprised in the puck 40, to the one or more receivers connected to the processing means. Upon receiving the signal indicating that an abrupt stop and/or change in direction of motion of the puck has occurred, the processing means resets the parameters of the Kalman filter.

The invention claimed is:

1. A puck having a centrally located cavity, the puck comprising:

a carrier structure having a rigid shell, the carrier structure being positioned within the centrally located cavity;

at least one transmitter circuit secured to and in direct contact with the carrier structure to prevent relative displacement among the transmitter circuit under mechanical stress; and a battery provided within the carrier structure, wherein the battery is embedded in a first elastic material provided within the carrier structure, and wherein the carrier structure is embedded in a second elastic material provided within the centrally located cavity, wherein the at least one transmitter circuit comprises a first transmitter circuit and a second transmitter circuit, wherein the puck further comprises:

a switching circuitry configured to determine which transmitter circuit of the first transmitter circuit or the second transmitter circuit is currently near a planar surface of the puck facing upwards using input provided by an inertial measurement unit, to activate the transmitter circuit near the planar surface of the puck currently facing upwards and to deactivate the transmitter circuit near a planar surface of the puck currently facing downwards.

2. The puck of claim 1, wherein the second elastic material has a hardness less than a hardness of the first elastic material.

3. The puck of claim 1, wherein the carrier structure is surrounded by a glass fiber thread infused with epoxy.

4. The puck of claim 2, wherein the carrier structure is surrounded by a glass fiber thread infused with epoxy.

5. The puck of claim 1, wherein the first elastic material is a two-component silicone rubber of hardness Shore A 40 or wherein the second elastic material is a two-component silicone rubber of hardness Shore A 0.

6. The puck of claim 2, wherein the first elastic material is a two-component silicone rubber of hardness Shore A 40 or wherein the second elastic material is a two-component silicone rubber of hardness Shore A 0.

7. The puck of claim 3, wherein the first elastic material is a two-component silicone rubber of hardness Shore A 40 or wherein the second elastic material is a two-component silicone rubber of hardness Shore A 0.

8. The puck of claim 1, wherein the first elastic material or the second elastic material exhibit a change in stiffness.

9. The puck of claim 2, wherein the first elastic material or the second elastic material exhibit a change in stiffness.

10. The puck of claim 3, wherein the first elastic material or the second elastic material exhibit a change in stiffness.

11. The puck of claim 1, wherein the first transmitter circuit is comprised in a first printed circuit board and the second transmitter circuit is comprised in a second printed circuit board, wherein the first printed circuit board is fitted to a top opening of the carrier structure and the second printed circuit board is fitted to a bottom opening of the carrier structure.

12. The puck of claim 11, wherein an antenna structure of the second printed circuit board is rotated by 90° with respect to an antenna structure of the first printed circuit board.

13. The puck of claim 1, wherein the battery is a rechargeable battery, and wherein the puck further comprises:

a coil that allows inductive charging of the rechargeable battery, and contacts on the puck surface which allow plugging a power supply for charging the rechargeable battery.

14. The puck of claim 1, wherein each of the at least one transmitter circuits is comprised in a respective transceiver circuitry.

15. A method for producing a puck comprising at least one transmitter circuit, comprising:

assembling a battery into a carrier structure having a rigid shell;

securing to and being in direct contact with at least one transmitter circuit to the carrier structure;

filling the inner volume of the carrier structure with a first elastic material;

inserting the carrier structure into a recess on the inner surface of a first half of the puck;

filling the remaining space with a second elastic material; and glueing a second half of the puck to the first half of the puck, wherein the second half of the puck has a recess such that the recess in the first half of the puck and the recess in the second half of the puck combine to form a cavity which is centrally located within the puck, wherein the at least one transmitter circuit comprises a first transmitter circuit and a second transmitter circuit, wherein the puck further comprises:

a switching circuitry configured to determine which transmitter circuit of the first transmitter circuit or the second transmitter circuit is currently near a planar surface of the puck facing upwards using input provided by an inertial measurement unit, to activate the transmitter circuit near the planar surface of the puck currently facing upwards and to deactivate the transmitter circuit near a planar surface of the puck currently facing downwards.

16. The method of claim 15, wherein the at least one transmitter circuit comprises a first transmitter circuit and a second transmitter circuit, wherein the first transmitter circuit is comprised in a first printed circuit board and the second transmitter circuit is comprised in a second printed circuit board, and wherein the method further comprises:

fitting the first printed circuit board to a top opening of the rigid shell of the carrier structure and fitting the second printed circuit board to a bottom opening of the rigid shell of the carrier structure.

17. The method of claim 16, wherein the rigid shell of the carrier structure has at least one hole located on faces of the rigid shell, and wherein filling the inner volume of the carrier structure with a first elastic material comprises injecting the first elastic material through at least one of the holes into the inner volume of the carrier structure.

18. The method of claim 15, further comprising, before inserting the carrier structure into a recess on the inner surface of a first half of the puck:

wrapping a glass-fiber thread infused with epoxy around the rigid shell of the carrier structure.

* * * * *